US007478511B2

(12) United States Patent
Thurgood et al.

(10) Patent No.: US 7,478,511 B2
(45) Date of Patent: Jan. 20, 2009

(54) PACKAGING MACHINE FOR PACKAGING CONTAINERS AND LIDS

(75) Inventors: Robin G. Thurgood, Marshall, MI (US); Brian C. Bowerman, Quincy, MI (US); Phillip D. Hillard, Hudson, MI (US)

(73) Assignee: Rennco LLC, Homer, MI (US)

( * ) Notice: Subject to any disclaimer, the term of this patent is extended or adjusted under 35 U.S.C. 154(b) by 0 days.

(21) Appl. No.: 11/924,150

(22) Filed: Oct. 25, 2007

(65) Prior Publication Data

US 2008/0104927 A1 May 8, 2008

Related U.S. Application Data

(62) Division of application No. 11/503,751, filed on Aug. 14, 2006, now Pat. No. 7,318,306.

(51) Int. Cl.
*B65B 35/50* (2006.01)
*B65G 57/16* (2006.01)

(52) U.S. Cl. ..... 53/155; 53/540; 53/542; 53/238; 53/258; 414/788.3; 414/789.6; 414/790.3; 414/798.4

(58) Field of Classification Search ..... 53/445, 53/447, 474, 475, 495, 500, 142, 152–155, 53/537, 540, 542, 237, 238, 247, 258; 198/890; 414/788.2, 788.3, 789.6, 790.3, 798.4, 802
See application file for complete search history.

(56) References Cited

U.S. PATENT DOCUMENTS 3,289,385 A * 12/1966 Syverson et al. ..... 53/434
3,791,537 A * 2/1974 Conklin ..... 414/788.2
4,024,951 A 5/1977 Green
4,193,494 A 3/1980 Green
4,555,891 A 12/1985 Sauerbruch
4,921,398 A * 5/1990 Fluck ..... 414/798.7
5,122,029 A * 6/1992 DelDuca ..... 414/789.2
5,222,861 A 6/1993 Focke et al.
5,410,859 A * 5/1995 Kresak et al. ..... 53/537
5,555,706 A * 9/1996 Maoloni et al. ..... 53/447
5,809,751 A * 9/1998 Braibanti ..... 53/543
6,241,457 B1 * 6/2001 Huttig et al. ..... 414/788.2
6,267,550 B1 * 7/2001 Morgan ..... 414/798.4
6,397,567 B1 * 6/2002 Focke et al. ..... 53/541
6,425,227 B1 * 7/2002 Salm et al. ..... 53/446
6,699,006 B2 * 3/2004 Schlimgen et al. ..... 414/801
6,851,920 B2 * 2/2005 Trautwein et al. ..... 414/798.4

* cited by examiner

*Primary Examiner*—Stephen F Gerrity
(74) *Attorney, Agent, or Firm*—Thompson Hine LLP

(57) ABSTRACT

An apparatus for use in packaging containers and associated lids together includes a moveable gantry with a first support portion and a second support portion alongside the first support portion. The first and second support portions are sized and configured to support the containers and the lids. A container path and a lid path are included along which containers and lids, respectively, are directed to the gantry. The gantry has a first orientation in which the first support portion is aligned with the container path to receive containers and the second support portion is aligned with the lid path to receive lids. The gantry also has a second orientation in which the gantry is repositioned such that the first support portion is aligned with the lid path to receive lids and the second support portion is aligned with the container path to receive containers.

21 Claims, 11 Drawing Sheets

PACKAGING MACHINE FOR PACKAGING CONTAINERS AND LIDS

This application is a divisional of and claims priority to U.S. application Ser. No. 11/503,751, filed Aug. 14, 2006, now U.S. Pat. No. 7,318,306.

TECHNICAL FIELD

The present application relates to packaging machines and more particularly to a packaging machine for arranging and packaging containers and their associated lids.

BACKGROUND

Cups are typically packaged for retail or commercial sale as nested stacks of cups. For example, it is not unusual to provide cups nested in two stacks (e.g., of 10 cups each for a total of 20 cups) within a plastic bag for retail sale, for example, in a grocery store, supermarket, gas station, etc.

Automated processes and machines have been provided to sort and arrange the cups into the nested stacks for packaging. Additionally, processes and machines have been proposed to handle nested stacks of cups. For example, a holding mechanism has been proposed having suction chambers with a lower suction opening for engaging a cup stack by negative pressure. The holding mechanism can be used to remove the cups stacks from a transport container.

SUMMARY

In an aspect, an apparatus for use in packaging containers and associated lids together includes a moveable gantry with a first support portion and a second support portion alongside the first support portion. The first and second support portions are sized and configured to support the containers and the lids. A container path and a lid path are included along which containers and lids, respectively, are directed to the gantry. The gantry has a first orientation in which the first support portion is aligned with the container path to receive containers and the second support portion is aligned with the lid path to receive lids. The gantry also has a second orientation in which the gantry is repositioned such that the first support portion is aligned with the lid path to receive lids and the second support portion is aligned with the container path to receive containers.

In another aspect, an automated method of packaging containers and associated lids together is provided. The method includes positioning a moveable gantry in a first orientation in which a first support portion of the moveable gantry is aligned with a container path along which containers are directed to the moveable gantry and a second support portion of the moveable gantry is aligned with a lid path along which lids are directed to the moveable gantry. With the moveable gantry in the first orientation, containers are moved along the container path onto the first support portion and lids are moved along the lid path onto the second support portion. The moveable gantry is positioned in a second orientation in which the first support portion is aligned with the lid path and the second support portion is aligned with the container path. With the moveable gantry in the second orientation, lids are moved along the lid path onto the first support portion and containers are moved along the container path onto the second support portion.

The details of one or more embodiments are set forth in the accompanying drawings and the description below. Other features, objects, and advantages will be apparent from the description and drawings, and from the claims.

DETAILED DESCRIPTION

Figure 1:
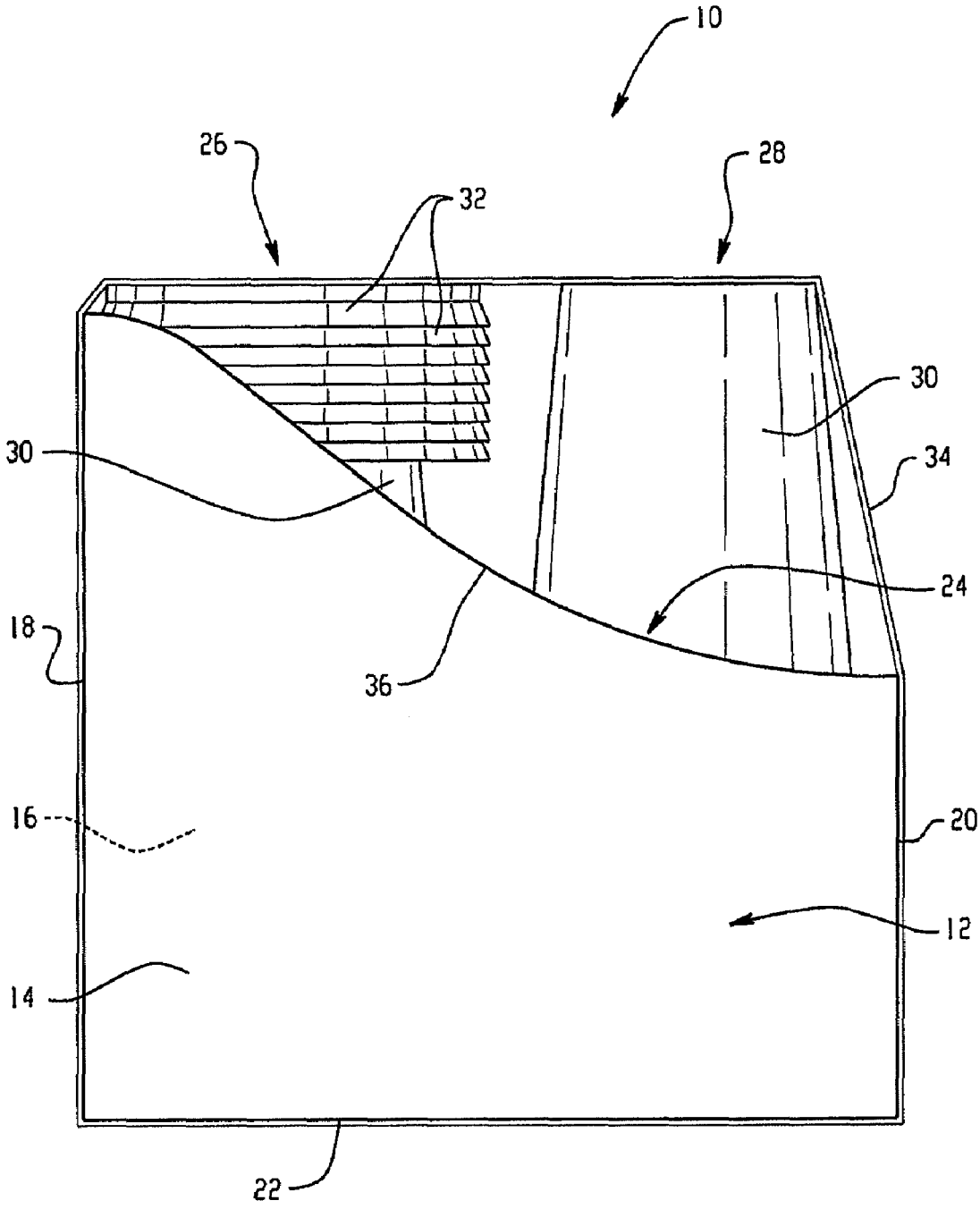
FIG. 1 is a front view of an embodiment of a packaged product.

Referring to FIG. 1, a packaged product 10 includes an open-ended packing receptacle 12 or sleeve (e.g., of cardboard, coated paper, plastic, etc.) having a front 14, a back 16, sides 18 and 20 and bottom 22 forming a volume 24 therebetween that is sized to receive stacks 26 and 28 of nested containers 30 (e.g., beverage cups) and their associated lids 32, which are also nested. A transparent wrapping 34 (e.g., of shrink wrap plastic) is wrapped about the stacks 26 and 28 and the receptacle 12 to form a sealed envelop about the stacks and the receptacle.

Side 18 is taller than side 20. Top edges (only edge 36 can be seen) are shaped to form a transition between the sides 18 and 20 of differing heights so that the stacks 26 and 28 are partially viewable through the wrapping 34 as shown.

Each stack 26 and 28 includes both containers 30 and associated lids 32. Stack 26 includes lids 32 on top with containers 30 disposed thereunder, while stack 28 includes the opposite arrangement with containers on top with lids disposed thereunder. Due to a tapered contour of the containers 30, this opposite arrangement of containers and lids 32 may be preferable, however, in other embodiments, each stack 26 and 28 may have the same arrangement of containers and lids. In some embodiments, stacks 26 and 28 may include the same number of containers 30 (e.g., two or more, such as seven) and lids 32. However, the number of containers 30 and lids 32 may differ as desired. In some embodiments, the containers 30 are coffee cups (e.g., 8, 12, 16 ounces) and the lids 32 are suitable for hot beverages and seal with rims of the coffee cups. An exemplary coffee cup is a Dixie® Perfec-Touch® paper coffee cup and a suitable lid 32 is a Perfec-Touch® hot cup lid, both available from Georgia-Pacific Corporation.

Figure 2:
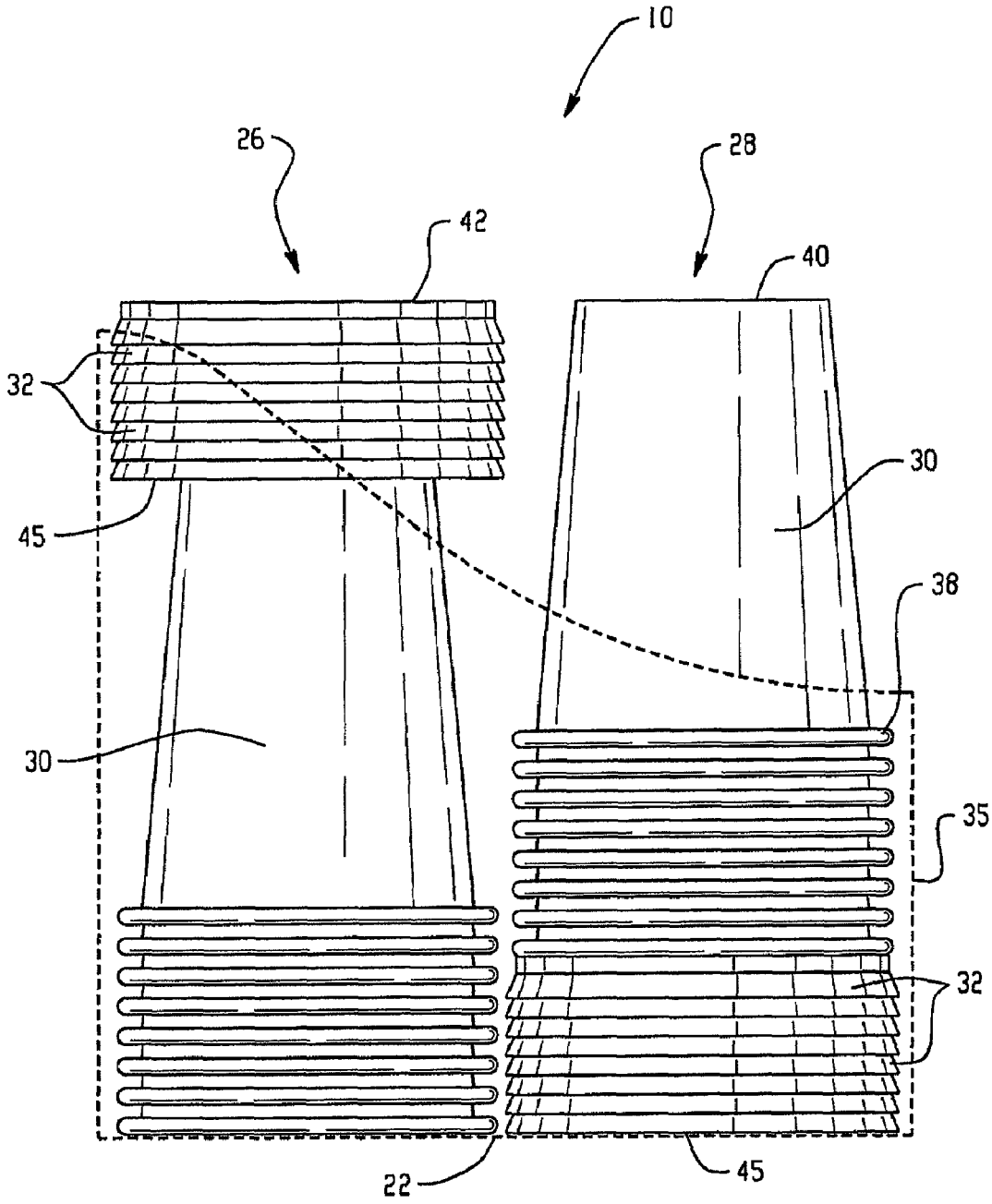
FIG. 2 is a front view of the packaged product of FIG. 1 with its receptacle shown in outline.

FIG. 2 shows the stacks 26 and 28 in isolation with the contour of the receptacle 12 shown by the dotted line 35. Each stack 26 and 28 includes a series of containers 30 having rims 38 and bottoms 40. As can be seen, the rims 38 all face toward the bottom 22 of the receptacle 12. Each stack 26 and 28 also includes a series of lids 32 having a rim 45 and a top 42. All the rims 45 of the lids 32 also face toward the bottom 22 of the receptacle 12. The lids 32 of stack 26 are nested with the bottom 40 of an uppermost container 30, while the containers 30 of stack 28 are nested with the top 42 of an uppermost lid.

Figure 3:
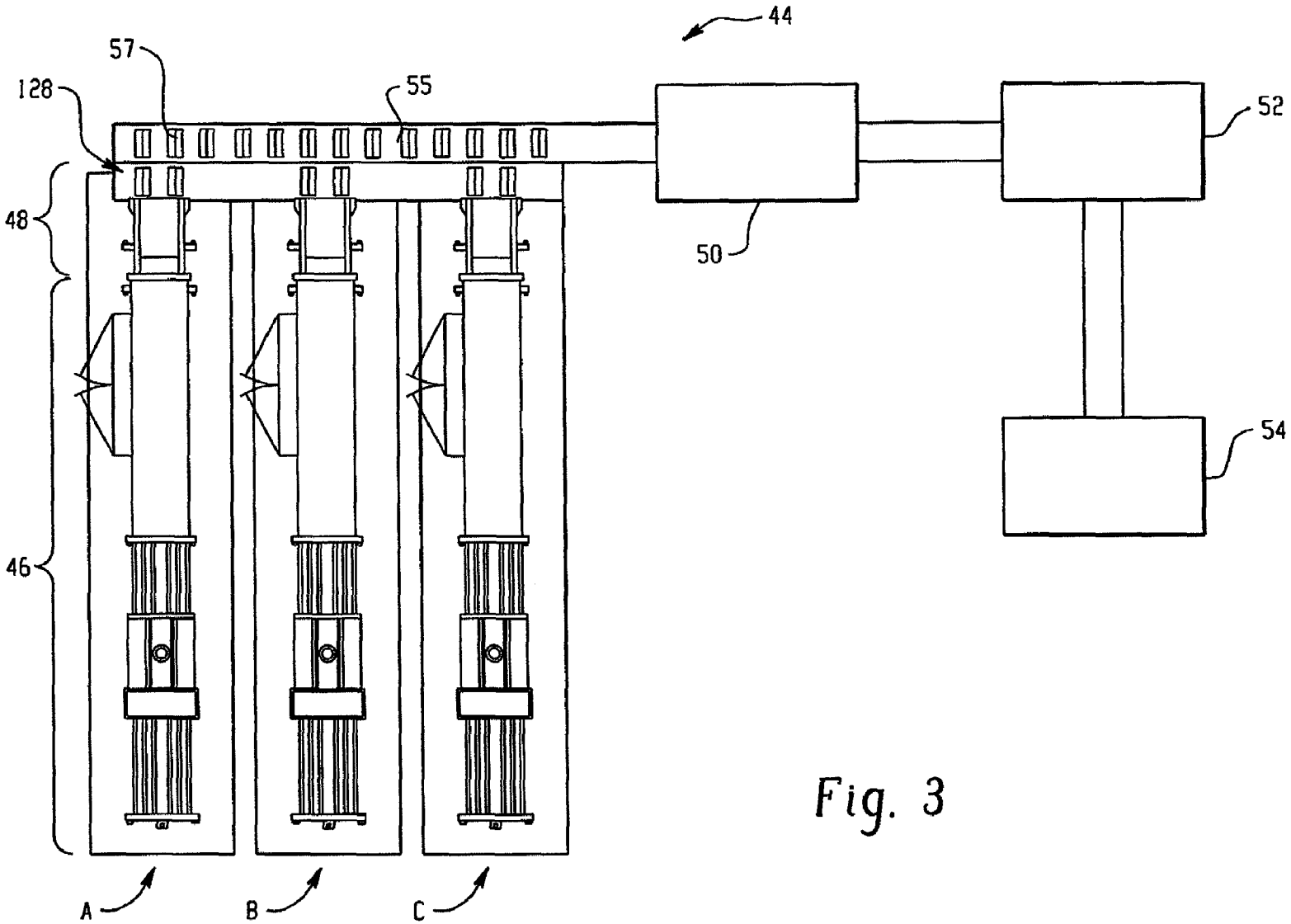
FIG. 3 is a schematic, plan view of an embodiment of an apparatus for forming the packaged product of FIG. 1.

Referring now to FIG. 3, a packaging machine 44 is used to arrange and locate both the containers 32 and their associated lids 32 within the receptacle 12, for example, as described above with reference to FIGS. 1 and 2. However, the packaging machine 44 may be used to form different arrangements of containers 30 and lids 32. The packaging machine 44 has lines A, B and C that each include an accumulation portion 46 where containers 30 and their associated lids 32 are fed into the packaging machine and pre-positioned and an arranging portion 48 where the containers and lids are arranged into the stacks 26 and 28. Each line A, B and C feeds into a cartoner portion 50 where the receptacle 12 is assembled and the stacks 26 and 28 are placed in the receptacle. A conveyor mechanism 55 including multiple, spaced apart receiving slots 57 is used to transport the stacks of containers and lids from the lines A, B and C to the downstream stations. A wrapping portion 52 is where the packaging machine 44 wraps the receptacle 12 and stacks 26, 28 within the wrapping 34 and a case packer 54 is where multiple packaged product 10 are packaged within a shipping case.

Figure 4:
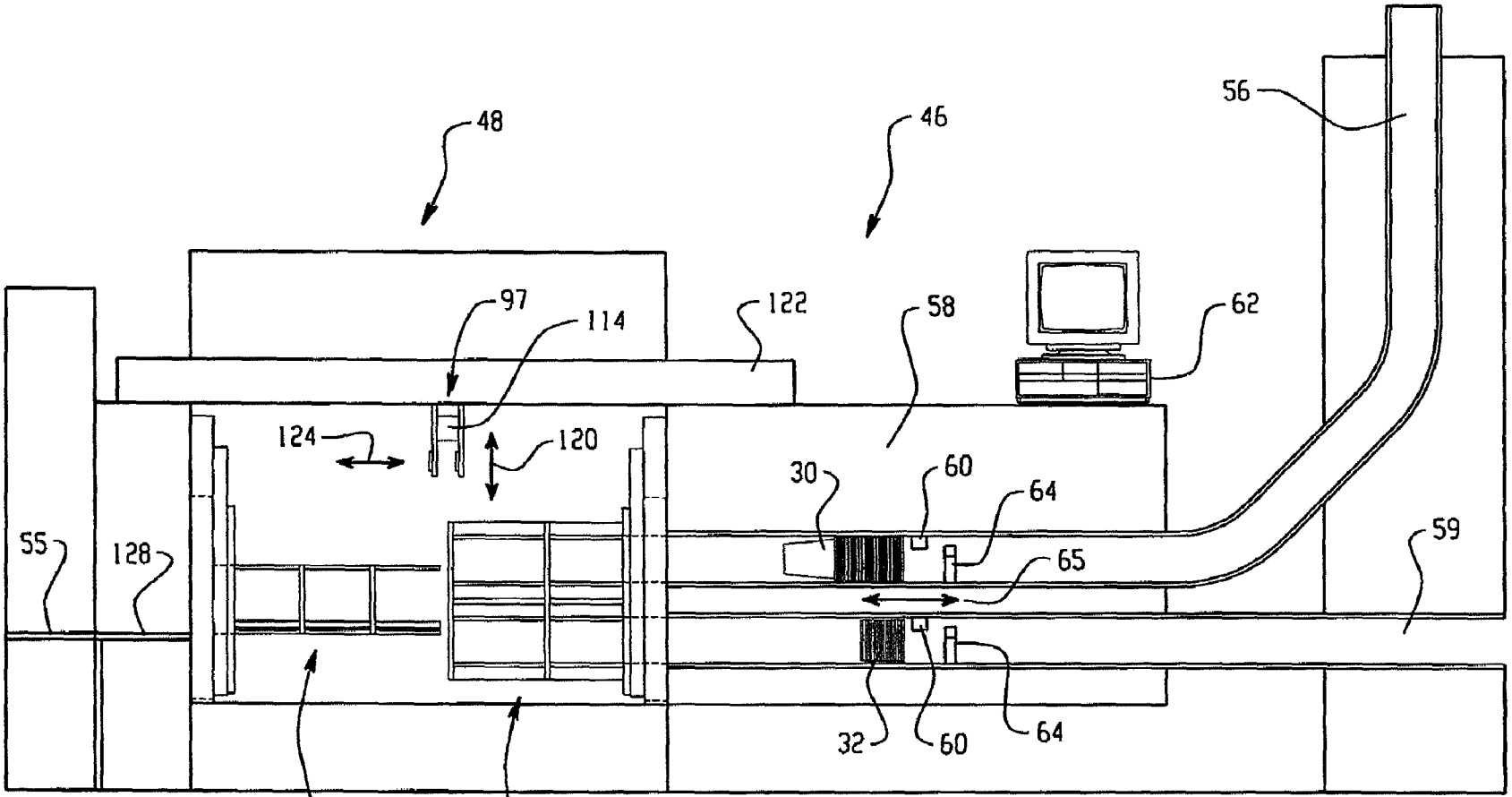
FIG. 4 is a side view of an arranging portion of the apparatus of FIG. 3.

FIG. 4 shows a side view of one of lines A, B, C including the accumulation and arranging portions 46 and 48 of the packaging machine 44. A container infeed 56 provides a container path to an accumulation region 58 where the containers 30 are pre-located for counting and dispensing operations. A lid infeed 59 is located beneath the container infeed 56 and provides a lid path to the accumulation region 58 where the lids 32 are pre-located below the containers 30 for similar counting and dispensing operations.

Associated with each of the container path and the lid path is a counting mechanism 60. Counting mechanisms 60 include a finger (not shown) biased into the associated path that ride along the respective containers and lids. When the fingers are deflected a sufficient amount (e.g., by the rims 38, 40 of the containers 30 and the lids 32), the counting mechanisms 60 provide a signal to a control 62 that is used to count the number of corresponding containers 30 and lids 32 that pass thereby. Other counting mechanisms may be used such as a photo eye system projecting a light across the path and positioned such that the path of light is broken and unbroken by the rims 38, 45 of the containers/lids. Once a pre-determined number of containers 30 and lids 32 (e.g., 2 or more, between 2 and 10, such as 7) have been counted and dispensed, a loading mechanism 64, controlled by control 62, moves (e.g., pushes) both the dispensed containers and lids along their respective paths in the direction of arrow 65 and onto an upstream gantry 66. In one example, loading mechanism 64 may include fingers (not shown) that can be extended toward the container or lid path, the extended fingers then moveable toward the gantry 66 via a servo-controlled linear actuator.

Figure 5A:
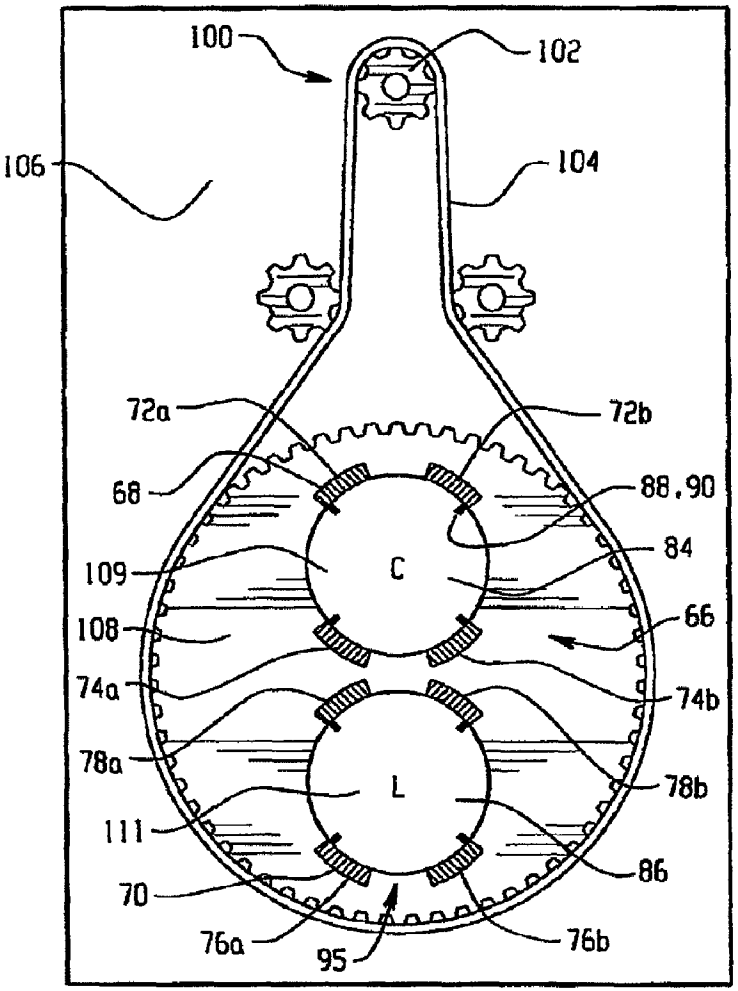
FIG. 5A is a section view of the gantry of FIG. 5 along line A-A.
Figure 5:
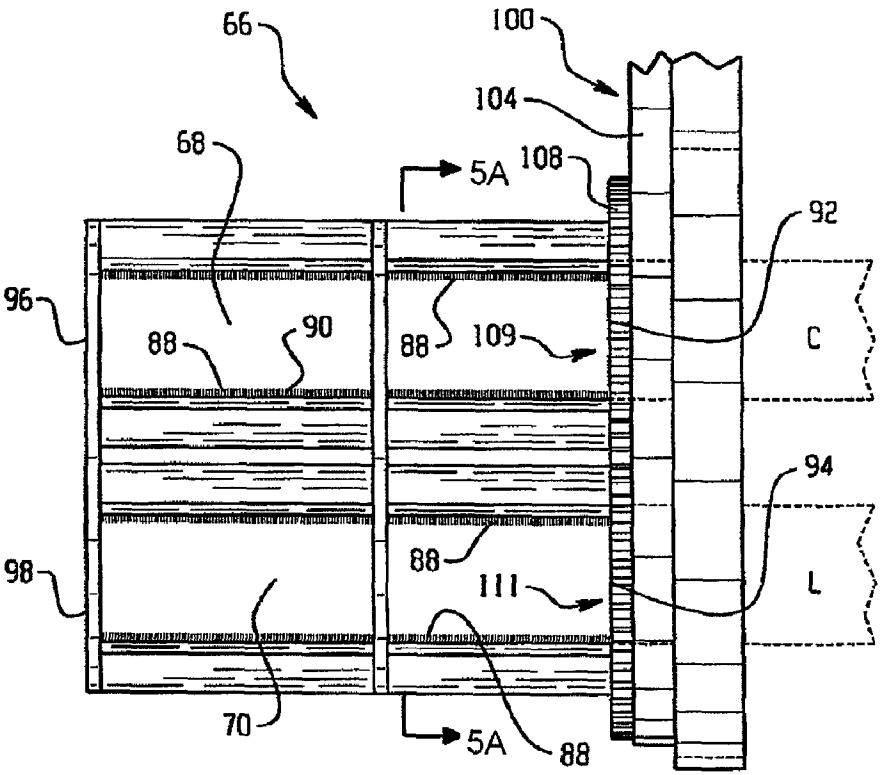
FIG. 5 is a side view of an embodiment of an upstream gantry used in the apparatus of FIG. 3.

Referring to FIG. 5, gantry 66 includes a first support portion 68 and a second support portion 70 spaced from and adjacent to the first support portion. Referring also to FIG. 5A, the first support portion 68 is formed by outer support members 72*a* and 72*b* and an inner support members 74*a* and 74*b*. The second support portion 70 is formed by outer support members 76*a* and 76*b* that are opposite the outer support members 72*a* and 72*b* and inner support members 78*a* and 78*b* next to the inner support members 74*a* and 74*b*. The support members 72 and 74, 76 and 78 have respective arcuate inner surfaces that oppose each other to form rounded, parallel channels 84 and 86 into which the containers 30 and lids 32 can enter.

The first and second support portions 68 and 70 include a loading end 92 and 94 through which the dispensed containers 30 and lids 32 pass onto the support portions and an opposite unloading end 96 and 98 through which the dispensed containers and lids pass from the first and second support portions. The loading ends 92 and 94 can each be placed in alignment with the container path C and the lid path L (each path outlined by dotted lines in FIG. 5) using a drive mechanism 100 that is controlled by the control 62, which can allow for delivery of both containers 30 and lids 32 to each first and second support portion 68 and 70.

As will be described in greater detail below, the support members 74*a* and 74*b*, 76*a* and 76*b*, 78*a* and 78*b* are spaced apart from each other to form a channel 95 into which a loading mechanism 97 can be positioned so that the containers 30 and lids can be moved or pushed from the gantry 66 (see FIG. 4). Each support member 72, 74, 76, 78 also includes an elongated brush 88 having bristles 90 that can positively engage the containers 30 and the lids 32 to hold them in their loaded positions with respect to the gantry 66 until a force is applied thereto.

Drive mechanism 100 is shown in FIG. 5A and includes a belt drive 102 (e.g., a servo-motor operatively connected to a pulley and operated by control 62) and a belt 104 (e.g., a timing belt such as a toothed belt, notch belt, etc.) that is operatively connected about a periphery of a round drive member 108 to transfer direct motion thereto. Drive member 108 is fixedly connected to the support members 72, 74, 76, 78 so that rotation of the drive member rotates the gantry 66 between its first orientation, as shown, where the first portion 68 is aligned with the container path and the second portion 70 is aligned with the lid path, and its second orientation where the second portion 70 is aligned with the container path and the first portion is aligned with the lid path. Drive member 108 includes openings 109 and 111 that allow for passage of the containers 30 and lids 32 into the first and second portions 68 and 70 from their respective paths. A support plate 106 supports the rotatable drive member 108 (e.g., using a bearing). While other drive arrangements may be used, use of the belt 104 allows the support portions 68 and 70 to be positioned side-by-side, next to each other, for example, without a drive shaft extending between the support portions.

Figure 6A:
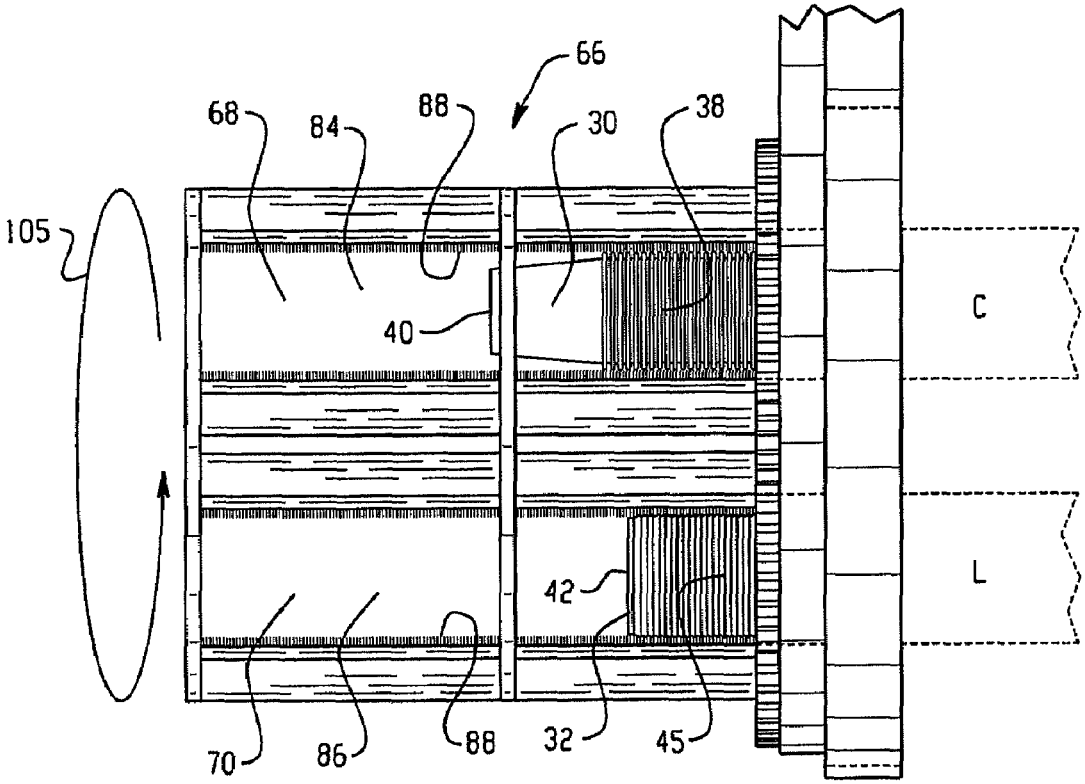
FIGS. 6A-6C illustrate an embodiment of a process of loading the gantry of FIG. 5 to form stacks of containers and lids used to form the product of FIG. 1.

Referring now to FIG. 6A, in a first loading step, the loading mechanism 64 (see FIG. 4) moves the dispensed containers 30 and the dispensed lids 32 onto the gantry 66 with the containers being moved into the first channel 84 and the lids being moved into the second channel 86. As can be seen, the bottoms 40 of the containers 30 and the tops 42 of the lids 32 lead in the direction of movement through the packaging machine 44 while the rims 38 of the containers and the rims 45 of the lids trail through the packaging machine. Brushes 88 positively engage the containers 30 and the lids 32 to hold the containers and lids in place once within the respective channels.

Figure 6B:
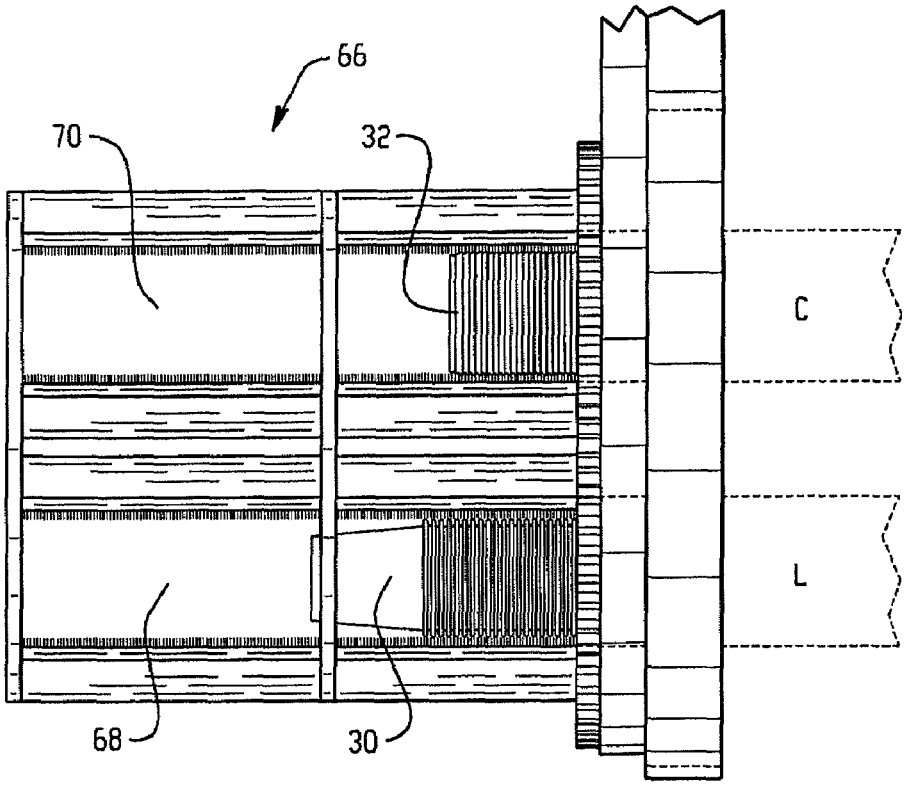
Figure 6C:
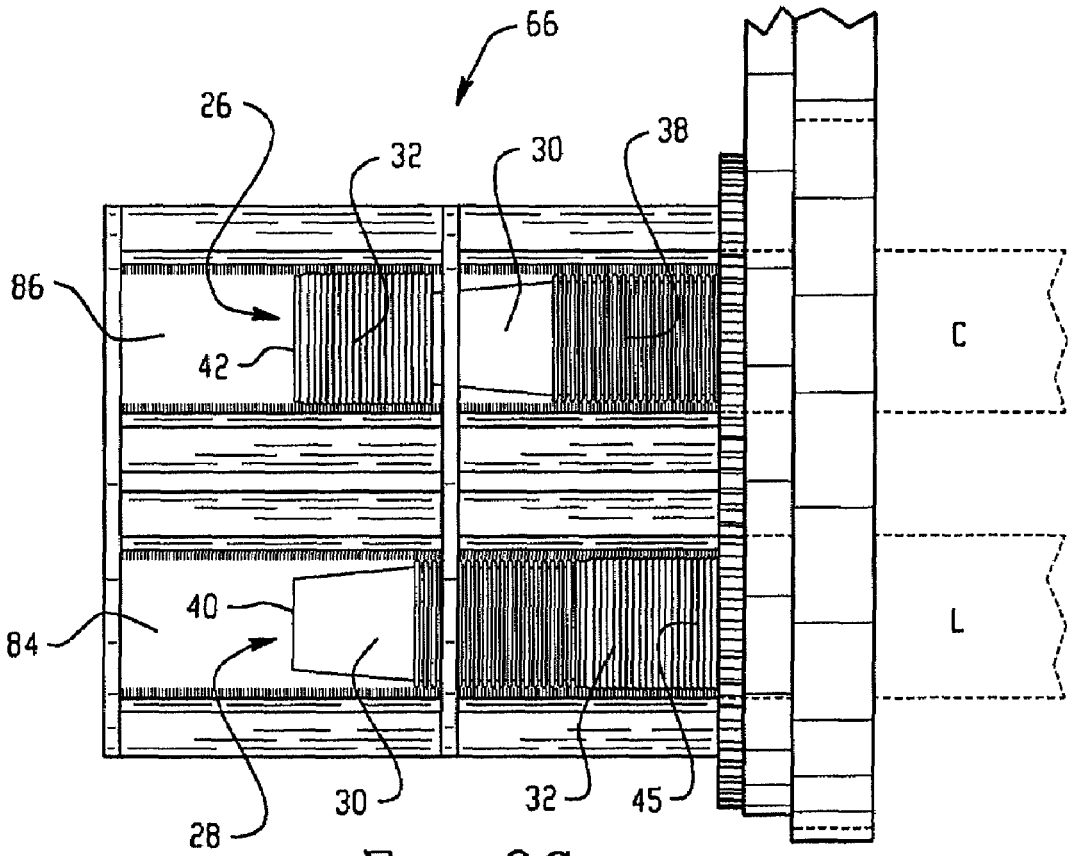

When the containers 30 and the lids 32 are in place on the support portions 68 and 70, the gantry 66 is rotated by the drive mechanism 100 in the direction of arrow 105 until the second support portion 70 is aligned with the container path and the first support portion 68 is aligned with the lid path (e.g., about 180 degrees) as shown by FIG. 6B. Another series of containers 30 and lids 32 are counted, dispensed and the loading mechanism 64 moves this series of containers and lids onto the gantry 66 to form the nested stacks 26 and 28 of both containers and lids within each channel 84 and 86 as shown by FIG. 6C. As above with FIG. 6A, the bottoms 40 and tops 42 of the next series of containers 30 and lids 32, respectively, are leading in the direction of movement through the packaging machine 44 while the rims 38 of the containers and the rims 45 of the lids trail through the packaging machine.

Figure 7A:
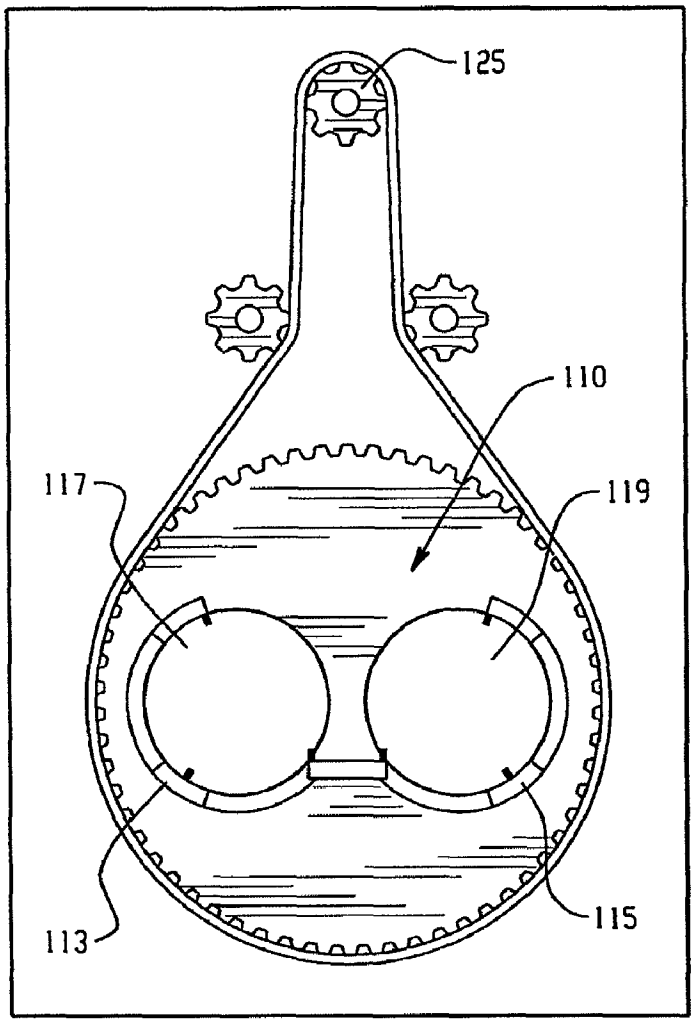
FIG. 7A is an end view of the downstream gantry of FIG. 7.
Figure 7:
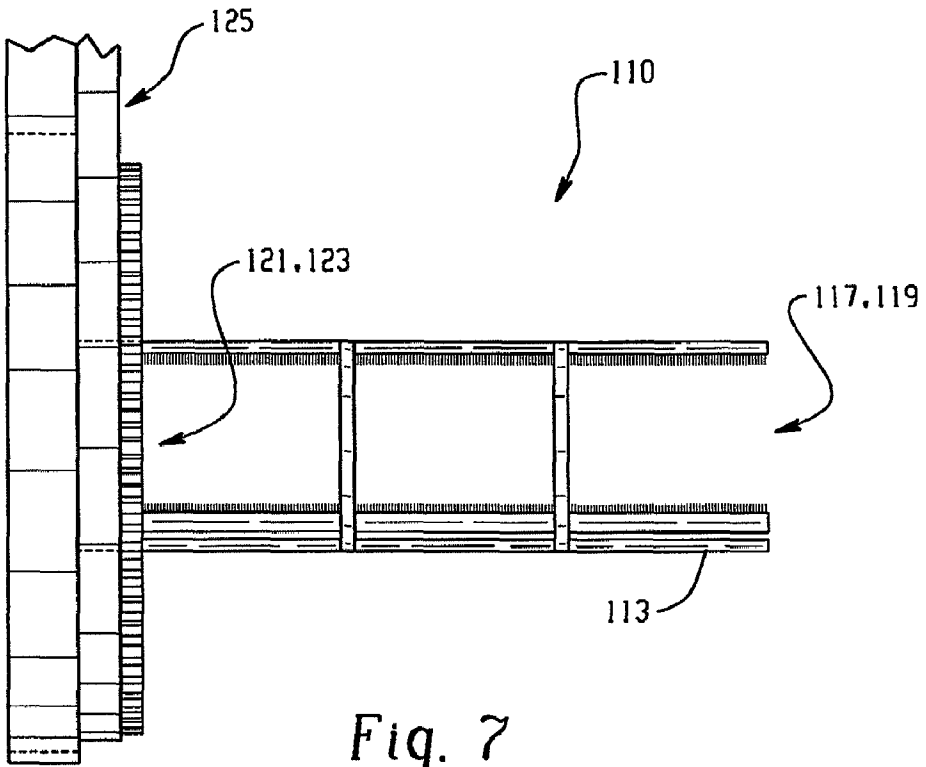
FIG. 7 is a side view of an embodiment of a downstream gantry.

Referring back to FIG. 4, a downstream gantry 110 is located next to the upstream gantry 66. Referring to FIGS. 7 and 7A, downstream gantry 110 includes many of the features of gantry 66 including a first support portion 113, second support portion 115, loading ends 117, 119, unloading ends 121, 123 and a drive mechanism 125 located, in this instance, at the unloading ends of the downstream gantry. Loading ends 117 and 119 of the downstream gantry 110 are aligned with the unloading ends 96 and 98 of the upstream gantry 66 to allow for transfer of the stacks 26 and 28 of containers 30 and lids 32 from the upstream gantry to the downstream gantry. As can be seen with reference to FIG. 4, loading mechanism 97 is used to transfer the stacks 26 and 28 from the upstream gantry 66 to the downstream gantry 110. The loading mechanism 97 includes both a vertical drive 114 (e.g., pneumatics) for moving pushers 116 and 118 vertically in the direction of arrow 120 and a horizontal drive 122 (such as a belt or chain drive or linear actuator) for moving the pushers horizontally in the direction of arrow 124 (FIG. 4).

Figure 8A:
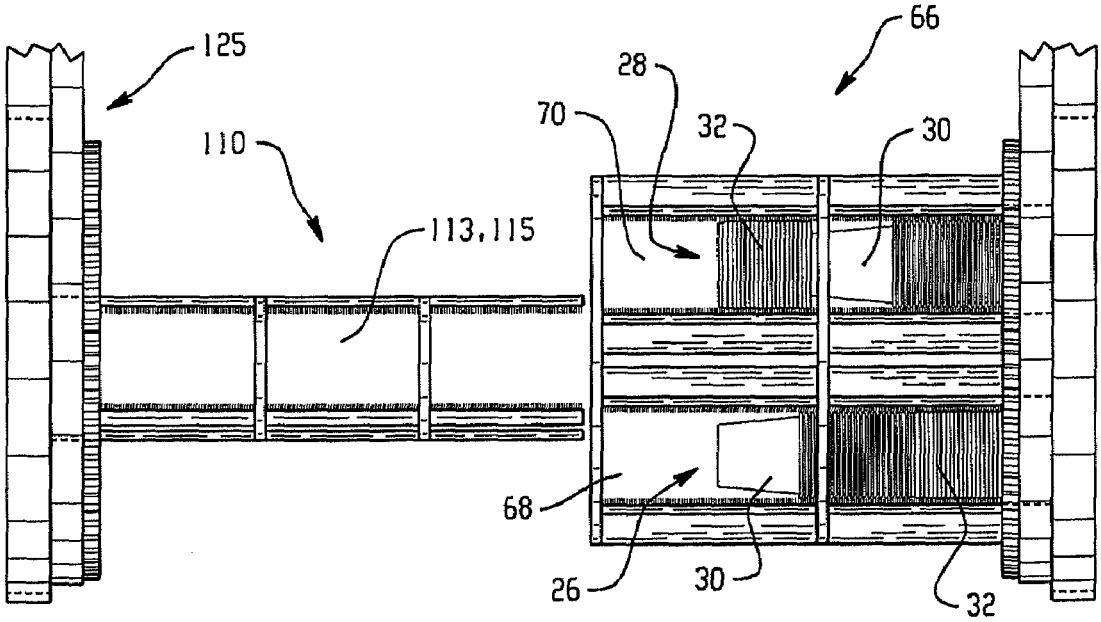
FIGS. 8A-8D illustrate an embodiment of a process of transferring the stacks from the upstream gantry of FIG. 5 to the downstream gantry of FIG. 7.
Figure 8B:
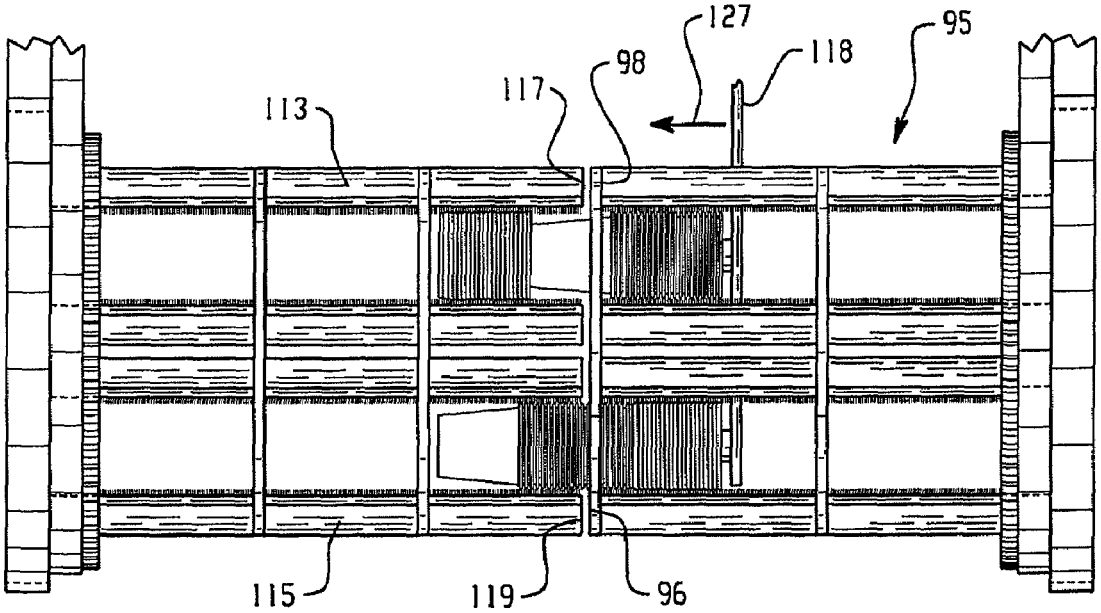
Figure 8C:
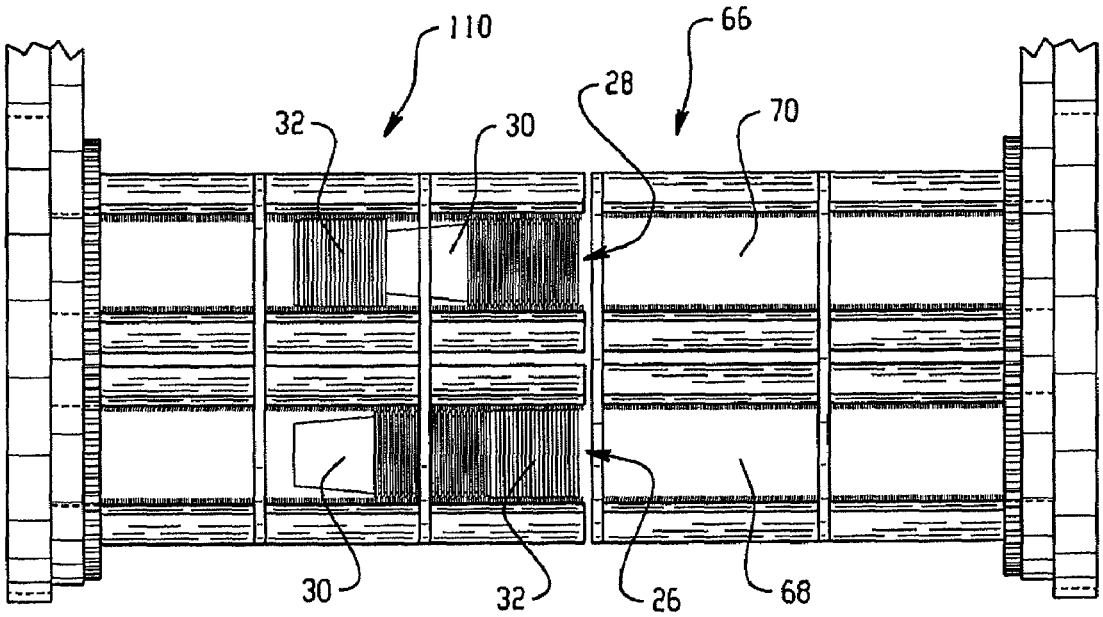
Figure 8D:
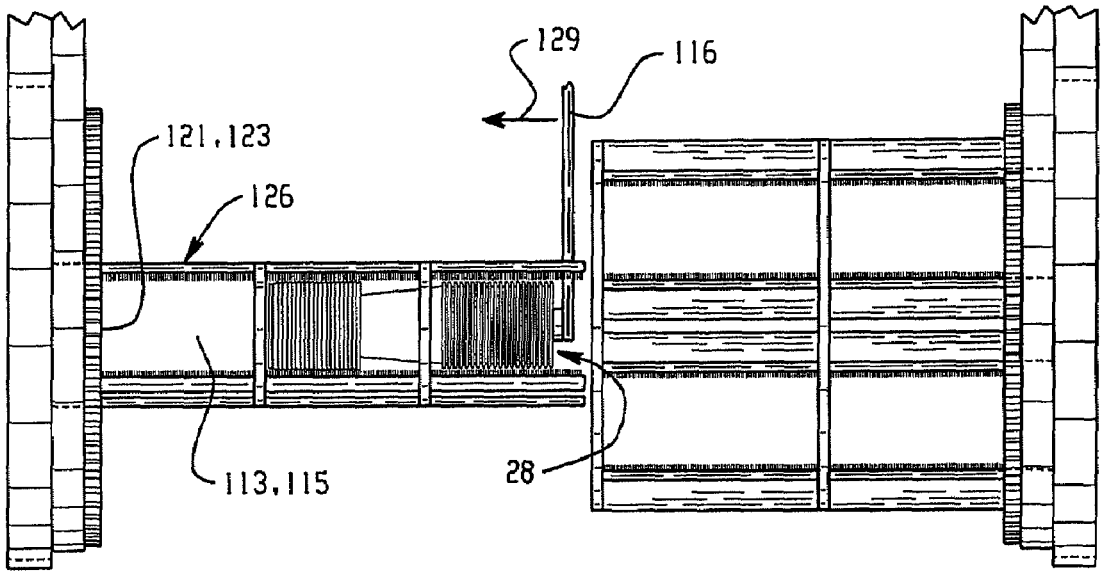

FIGS. 8A-8D illustrate a transferring and repositioning operation after the upstream gantry 66 is loaded with stacks 26 and 28. FIG. 8A shows an initial orientation with the upstream gantry 66 in its vertical orientation with the stacks 26 and 28 of containers 30 and lids 32 located in the first and second support portions 68 and 70. Downstream gantry 110 is in a horizontal position where its first and second support portions 113 and 115 are not aligned with those of the upstream gantry 66. Downstream gantry 110 is rotated (e.g., about 90 degrees) using its drive mechanism 125 to align the loading ends 117 and 119 of the downstream gantry 110 and unloading ends 96 and 98 of the upstream gantry 66 as shown by FIG. 8B. The loading mechanism 97 is lowered vertically and the pusher 118 is lowered into the channel 95. Once in place within the channel 95, the pusher 118 is advanced horizontally in the direction of arrow 127 to push the stacks 26 and 28 of containers 30 and lids 32 into the first and second support portions 113 and 115 of the downstream gantry 110 as shown by FIG. 8C. Referring now to FIG. 8D, with the stacks 26 and 28 loaded onto the downstream gantry 110, the drive mechanism 125 rotates the downstream gantry 110 back to its initial, horizontal orientation. Pusher 116 is lowered into a channel 126 associated with the downstream gantry 110 and advances horizontally in the direction of arrow 129 to push the stacks 26 and 28 of containers 30 and lids 32 through the unloading ends 121 and 123 and onto a support 128 where the stacks rest before being moved onto the conveyor mechanism 55 to be carried to the downstream stations (see FIG. 3) for placing the arranged stacks 26 and 28 into the receptacle, wrapping the stacks and receptacle and packaging the wrapped product.

Figure 9:
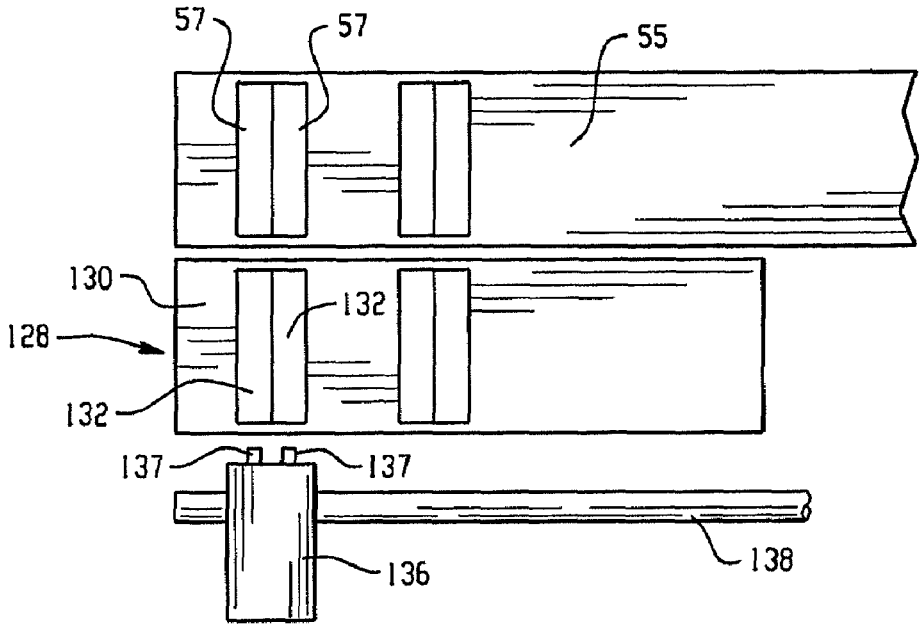
FIG. 9 is a schematic, plan view of an embodiment of a conveyor mechanism for use in transporting containers and lids from the downstream gantry of FIG. 7.

In one example shown by FIG. 9, the support 128 may be formed by an intermediate conveyor mechanism 130 with multiple pairs of spaced-apart receiving slots 132 (e.g., channels) adapted to receive the container/lid stacks 26, 28 from the downstream gantry 110 (shown by FIG. 8D for example). The intermediate conveyor mechanism 130 is stopped with slots 132 in alignment with the downstream gantry 110, at which point the container/lid stacks 26, 28 are moved onto the intermediate conveyor mechanism. Movement of the intermediate conveyor mechanism 130 is then initiated at a speed to match the movement of conveyor mechanism 55 so that a pusher 136 with extendable pusher arms 137 can move the container/lid stacks 26, 28 onto the receiving slots 57 of the conveyor mechanism 55 while both the conveyor mechanism and intermediate conveyor mechanism 130, along with the pusher 136 are moving. In this regard, the pusher 136 may be moveable along a support 138 by a suitable servo-drive arrangement. Each conveyor line may have its own intermediate conveyor mechanism and associated pusher. In one alternative embodiment, support 128 could be stationary and the conveyor mechanism 55 could be temporarily stopped while the container/lid stacks 26, 28 are moved from the support into the receiving slots 57. While not shown by FIG. 9, while the container/lid stacks 26, 28 are being unloaded from the downstream gantry 110, a new loading process for the upstream gantry 66 can be taking place, thereby increasing the overall repetition speed of the machine 44.

Figure 10:
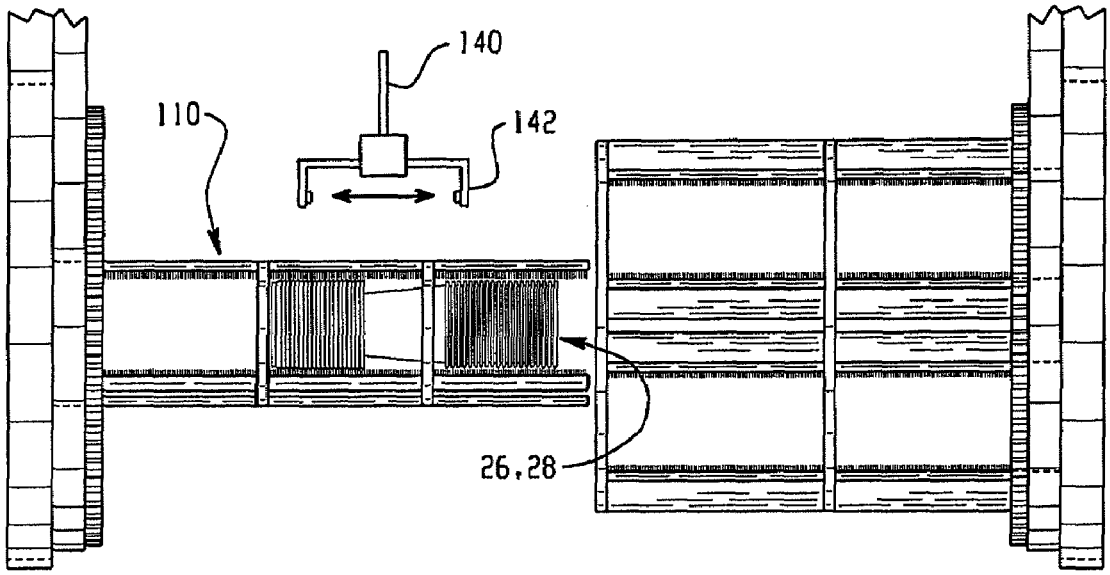
FIG. 10 is a schematic view of another embodiment of a mechanism for use in transporting containers and lids from the downstream gantry of FIG. 7.

In another embodiment, referring to FIG. 10, a robotic arm 140 including actuating gripper 142 may be used to grip the stacks 26 and 28 (e.g., together or individually) and lift them out of the downstream gantry 110. In this embodiment, an intermediate conveyor mechanism may not be needed as the robotic arm 140 may be used to place the stacks 26 and 28 directly onto the receiving slots 57 of the conveyor mechanism 55.

Packaging machine 44 provides an automated process for arranging and packaging both containers 30 and lids 32 in a package. Stacks 26 and 28 are formed of pre-selected quantities of both containers 30 and lids 32 that are nested together and placed closely side-by-side within the receptacle 12. Control 62 may allow for user input of certain operating parameters such as selection of a number of containers 30 and lids 32 forming the stacks 26 and 28. Control 62 may also include an electronic stop to allow an operator to shut down the packaging machine 44. While FIG. 3 depicts a system in which three container/lid arranging lines A, B and C are shown feeding a single conveyor mechanism, it is recognized that a single line system, a two line system or a four or more line system could be provided.

It is to be clearly understood that the above description is intended by way of illustration and example only and is not intended to be taken by way of limitation, and that changes and modifications are possible. Accordingly, other embodiments are within the scope of the following claims.

What is claimed is:

1. An apparatus for use in packaging containers and associated lids together, the apparatus comprising:

a moveable gantry including a first support portion and a second support portion alongside the first support portion, the first and second support portions sized and configured to support the containers and the lids;

a container path along which containers are directed to the gantry; and a lid path along which lids are directed to the gantry;

the gantry having a first orientation in which the first support portion is aligned with the container path to receive containers and the second support portion is aligned with the lid path to receive lids, and a second orientation in which the gantry is repositioned such that the first support portion is aligned with the lid path to receive lids and the second support portion is aligned with the container path to receive containers.

2. The apparatus of claim 1 further comprising at least one loading mechanism for moving containers and lids along their respective paths and into the gantry;

a gantry drive for moving the gantry between the first orientation and the second orientation; and a control associated with the loading mechanism and the gantry drive, the control operable to cause the following operations (i) cause the gantry drive to place the gantry in the first orientation and cause the loading mechanism to load containers into the first support portion and lids into the second support portion; and (ii) subsequent to operation (i), cause the gantry drive to place the gantry in the second orientation and cause the loading mechanism to load lids into the first support portion and containers into the second support portion, such that the first support portion includes a series of containers followed by a series of lids and the second support portion includes a series of lids followed by a series of containers.

3. The apparatus of claim 2 further comprising a gantry unload mechanism for moving containers and lids out of the first and second support portions at an exit side of the gantry that is opposite a loading side of the gantry, the control associated with the gantry unload mechanism, the control operable such that (iii) subsequent to operation (ii), the gantry unload mechanism moves the containers and lids out of the first and second support portions.

4. The apparatus of claim 3, wherein the gantry is an upstream gantry, the apparatus further comprising a downstream gantry located to receive the containers and lids when moved out of the upstream gantry by the gantry unload mechanism.

5. The apparatus of claim 4 further comprising a gripper to grasp and move the containers and lids from the downstream gantry, the control operable to control the gripper.

6. The apparatus of claim 4 further comprising:

a conveyor mechanism including multiple, spaced apart receiving slots that travel past an exit side of the downstream gantry, the control associated with the conveyor mechanism for movement thereof, the control operable such that (iv) the conveyor is stopped and, subsequent to operation (iii), the gantry unload mechanism unloads containers and lids from the downstream gantry into spaced apart receiving slots.

7. The apparatus of claim 2 wherein the gantry drive includes a belt operatively connected to the gantry to move the gantry between the first and second orientations, the belt located outside a loading zone defined by respective entry paths into the first and second support portions.

8. The apparatus of claim 7, wherein the gantry is rotated about an axis of rotation, the belt drive rotating the gantry between the first and second orientations.

9. The apparatus of claim 8, wherein the control causes the gantry drive to rotate the gantry about 180 degrees between the first and second orientations.

10. The apparatus of claim 1 further comprising an elongated brush extending along a length of each support portion, the brush having an array of bristles arranged and configured to positively engage containers and lids.

11. The apparatus of claim 1 further comprising a cartoner station where stacks of arranged containers and lids are placed within a receptacle.

12. The apparatus of claim 11 further comprising a wrapping station where the stacks and receptacle are wrapped with a plastic film.

13. An apparatus for use in packaging containers and associated lids together, the apparatus comprising:

a container path;

a lid path alongside the container path;

a moveable support member having a first orientation in which a first support portion is aligned with the container path to receive containers and a second support portion is aligned with the lid path to receive lids, and a second orientation in which the moveable support member is repositioned such that the first support portion is aligned with the lid path to receive lids and the second support portion is aligned with the container path to receive containers.

14. The apparatus of claim 13 further comprising at least one loading mechanism for moving containers and lids along their respective paths and into the moveable support member; and a drive for moving the moveable support member between the first orientation and the second orientation.

15. The apparatus of claim 14 further comprising a control associated with the loading mechanism and the drive, the control operable to cause the following operations (i) cause the drive to place the moveable support member in the first orientation and cause the loading mechanism to load containers into the first support portion and lids into the second support portion; and (ii) subsequent to operation (i), cause the drive to place the moveable support member in the second orientation and cause the loading mechanism to load lids into the first support portion and containers into the second support portion, such that the first support portion includes a series of containers followed by a series of lids and the second support portion includes a series of lids followed by a series of containers.

16. The apparatus of claim 15 further comprising an unload mechanism for moving containers and lids out of the first and second support portions at an exit side of the moveable support member that is opposite a loading side of the moveable support member, the control associated with the unload mechanism, the control operable such that (iii) subsequent to operation (ii), the unload mechanism moves the containers and lids out of the first and second support portions.

17. The apparatus of claim 16, wherein the moveable support member is an upstream moveable support member, the apparatus further comprising a downstream moveable support member located to receive the containers and lids when moved out of the upstream moveable support member by the unload mechanism.

18. The apparatus of claim 16 further comprising a gripper to grasp and move the containers and lids from the downstream moveable support member, the control operable to control the gripper.

19. The apparatus of claim 16 further comprising:

a conveyor mechanism including multiple, spaced apart receiving slots that travel past an exit side of the downstream moveable support member, the control associated with the conveyor mechanism for movement thereof, the control operable such that (iv) the conveyor is stopped and, subsequent to operation (iii), the unload mechanism unloads containers and lids from the downstream moveable support member into spaced apart receiving slots.

20. The apparatus of claim 14 wherein the drive includes a belt operatively connected to the moveable support member to move the moveable support member between the first and second orientations, the belt located outside a loading zone defined by respective entry paths into the first and second support portions.

21. The apparatus of claim 20, wherein the moveable support member is rotated about an axis of rotation, the drive rotating the moveable support member between the first and second orientations using the belt.

* * * * *

UNITED STATES PATENT AND TRADEMARK OFFICE

CERTIFICATE OF CORRECTION

PATENT NO. : 7,478,511 B2
APPLICATION NO. : 11/924150
DATED : January 20, 2009
INVENTOR(S) : Robin G. Thurgood, Brian C. Bowerman and Phillip D. Hillard It is certified that error appears in the above-identified patent and that said Letters Patent is hereby corrected as shown below:

Claim 18, Column 8, Line 54 replace "Claim 16" with -- Claim 17 --

Claim 19, Column 8, Line 58 replace "Claim 16" with -- Claim 17 --

Signed and Sealed this

Fourteenth Day of July, 2009

John Doll

JOHN DOLL
*Acting Director of the United States Patent and Trademark Office*